US010358792B2

(12) United States Patent
Risi

(10) Patent No.: US 10,358,792 B2
(45) Date of Patent: Jul. 23, 2019

(54) EXCAVATING EQUIPMENT FOR EXCAVATING SURFACES, IN PARTICULAR SOLID SURFACES, AND OPERATING MACHINE EQUIPPED WITH SAID EXCAVATING EQUIPMENT

(71) Applicant: SIMEX ENGINEERING S.R.L., San Giovanni in Persiceto (Bologna) (IT)

(72) Inventor: Mirco Risi, San Giovanni in Persiceto (Bologna) (IT)

(73) Assignee: Simex Engineering S.R.L., San Giovanni in Persiceto (Bologna) (IT)

( * ) Notice: Subject to any disclaimer, the term of this patent is extended or adjusted under 35 U.S.C. 154(b) by 20 days.

(21) Appl. No.: 15/510,145

(22) PCT Filed: Sep. 10, 2015

(86) PCT No.: PCT/EP2015/070687
§ 371 (c)(1),
(2) Date: Mar. 9, 2017

(87) PCT Pub. No.: WO2016/038126
PCT Pub. Date: Mar. 17, 2016

(65) Prior Publication Data

US 2017/0254046 A1 Sep. 7, 2017

(30) Foreign Application Priority Data

Sep. 10, 2014 (IT) ..... MI2014A1567

(51) Int. Cl.
*E01C 23/09* (2006.01)
*E01C 23/088* (2006.01)
(Continued)

(52) U.S. Cl.
CPC ..... *E02F 5/08* (2013.01); *E01C 23/088* (2013.01); *E01C 23/0933* (2013.01);
(Continued)

(58) Field of Classification Search
CPC ..... E01C 23/0933; E01C 23/0946; E01C 23/088; E01C 23/127; E02F 5/14; E02F 5/145; E02F 5/08
(Continued)

(56) References Cited

U.S. PATENT DOCUMENTS 496,699 A 5/1893 Quinn
5,373,902 A * 12/1994 Lindblom ..... E02F 3/188 172/112
(Continued)

FOREIGN PATENT DOCUMENTS

DE 102008024651 4/2009
GB 2150620 7/1985
(Continued)

OTHER PUBLICATIONS

International Search Report and Written Opinion for corresponding PCT Application No. PCT/EP2015/070687 dated Dec. 9, 2015.

*Primary Examiner* — David J Bagnell
*Assistant Examiner* — Michael A Goodwin
(74) *Attorney, Agent, or Firm* — Abelman, Frayne & Schwab

(57) ABSTRACT

Equipment (10) for excavating solid surfaces S such as for example made of asphalt or cement or similar solid material, in particular for obtaining or excavating trenches in said solid surfaces, said equipment (10) comprising working or excavating means (16) rotatably supported by a main frame (11), and a setting frame (30) which defines at least one contact portion (33) substantially flat and adapted to be put into contact with a corresponding portion of the surface S to be worked on, wherein the position of said setting frame (30) with respect to said main supporting frame (11) may be set so as to set the working depth K of said working means (16); wherein the said setting frame (30) is rotatably not constrained to said main supporting frame (11) in such a way
(Continued)

that the setting frame, regardless of the particular working conditions, always perfectly lies on the surface to be worked on S.

17 Claims, 9 Drawing Sheets

(51) Int. Cl.

| | |
|---|---|
| ***E01C 23/12*** | (2006.01) |
| ***E02F 5/08*** | (2006.01) |
| ***E02F 5/14*** | (2006.01) |
| ***E02F 3/18*** | (2006.01) |
| ***E02F 9/22*** | (2006.01) |
| *E02F 3/34* | (2006.01) |
| *E02F 9/28* | (2006.01) |

(52) U.S. Cl.
CPC ..... *E01C 23/127* (2013.01); *E02F 3/183* (2013.01); *E02F 3/188* (2013.01); *E02F 5/14* (2013.01); *E02F 9/2271* (2013.01); *E02F 3/3414* (2013.01); *E02F 9/2866* (2013.01)

(58) Field of Classification Search
USPC ..... 299/39.6
See application file for complete search history.

(56) References Cited

U.S. PATENT DOCUMENTS

| | | | | |
|---|---|---|---|---|
| 5,381,616 | A * | 1/1995 | Disney | E02F 3/188 37/189 |
| 5,382,084 | A * | 1/1995 | Diver | E01C 23/088 299/39.5 |
| 6,247,757 | B1 * | 6/2001 | Cochran | E01C 23/088 172/78 |
| 6,623,083 | B1 * | 9/2003 | Risi | E01C 23/088 299/39.4 |
| 2009/0232598 | A1 * | 9/2009 | Cochran | E01C 23/088 404/86 |
| 2012/0200140 | A1 * | 8/2012 | Nagasawa | B28D 1/045 299/39.3 |
| 2014/0197673 | A1 * | 7/2014 | Fanslow | E01C 23/09 299/39.3 |

FOREIGN PATENT DOCUMENTS

| | | |
|---|---|---|
| WO | 91/14836 | 10/1991 |
| WO | 01/25545 | 4/2001 |

* cited by examiner

FIG 2a *(PRIOR ART)*
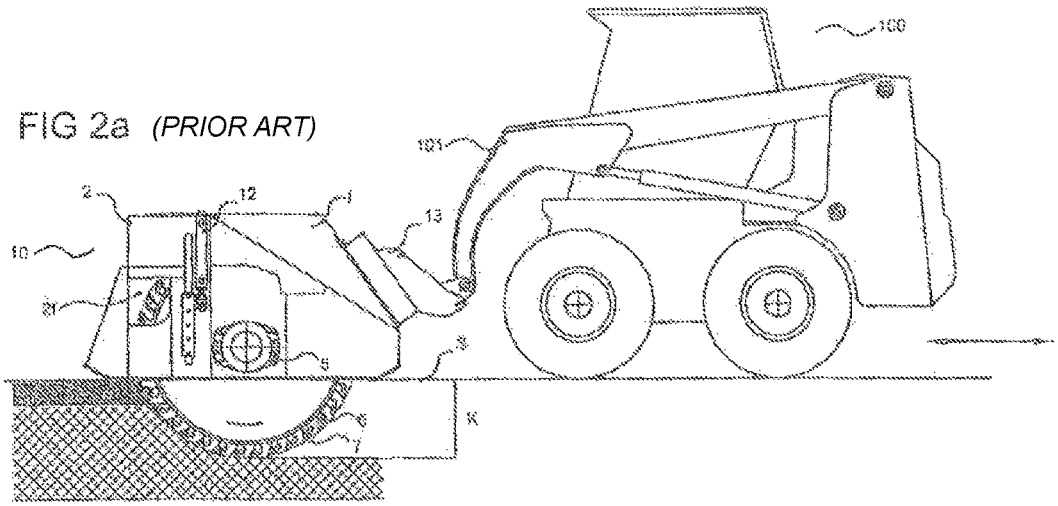
FIG 2b *(PRIOR ART)*
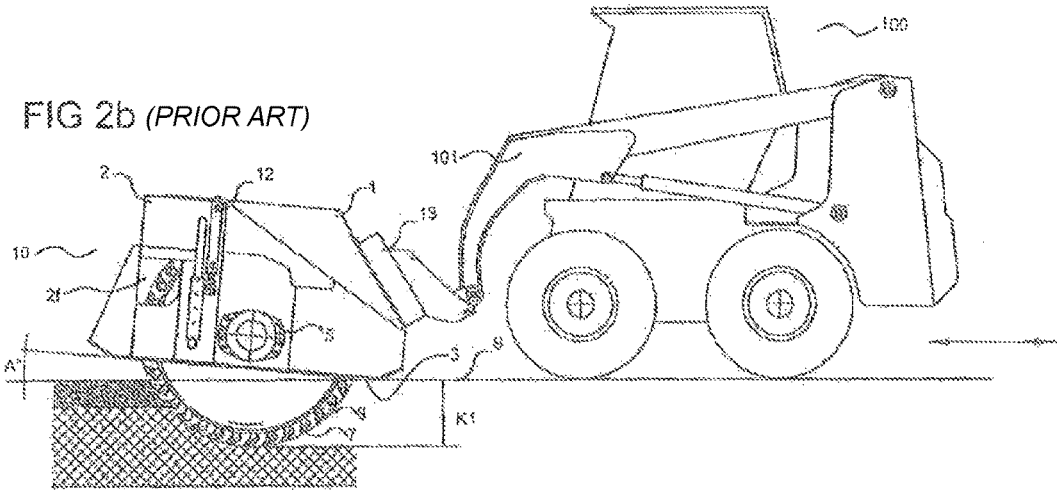
FIG 2c *(PRIOR ART)*
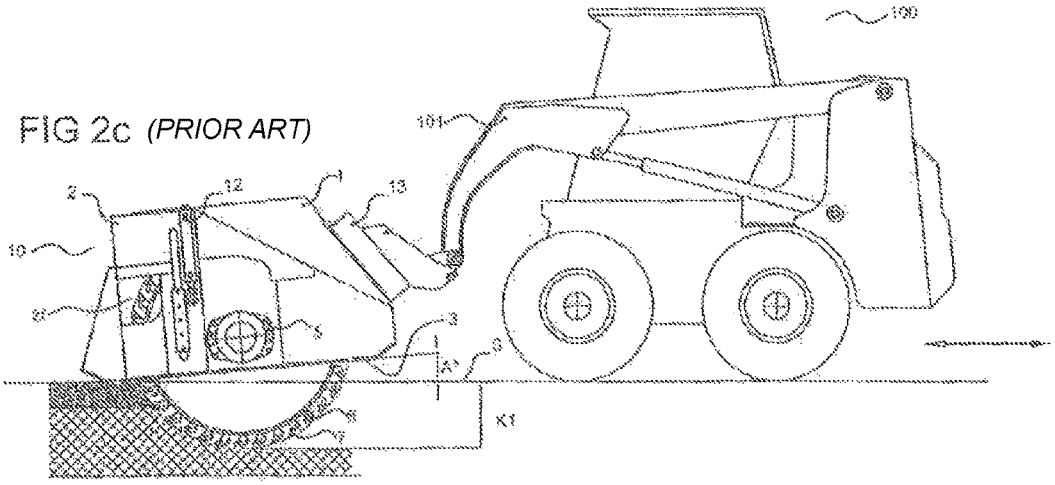

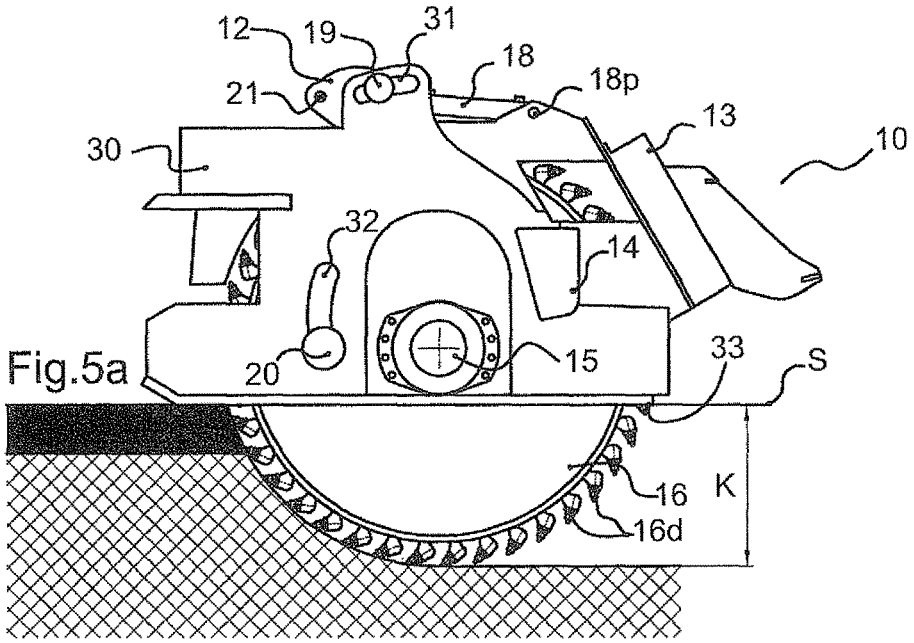
Fig.5a
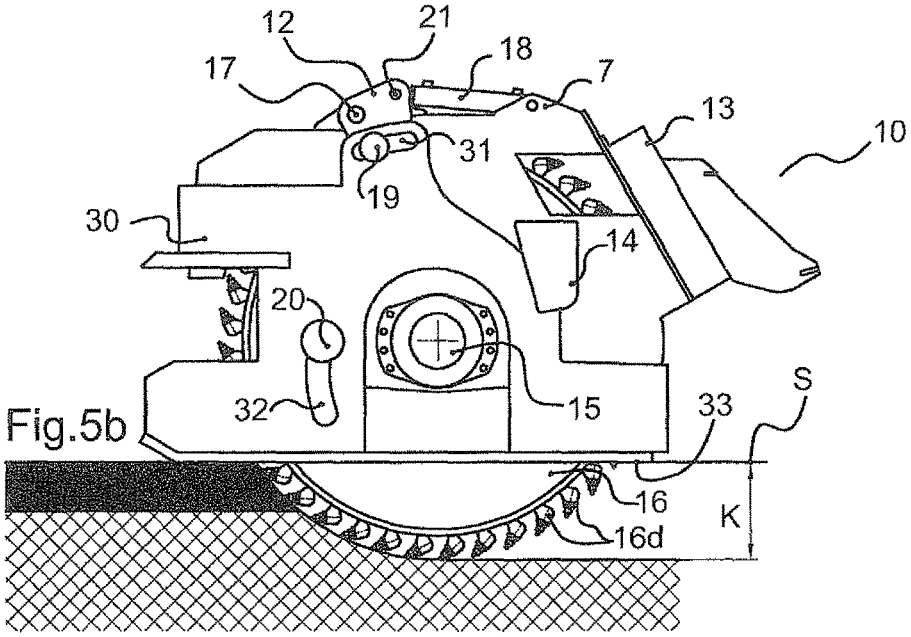
Fig.5b
Fig.5c
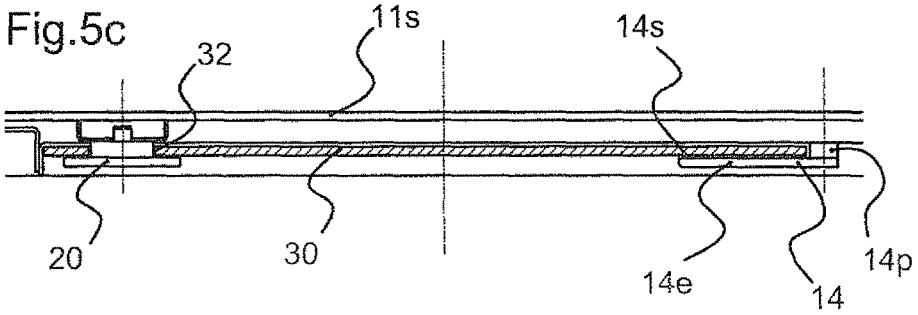

EXCAVATING EQUIPMENT FOR EXCAVATING SURFACES, IN PARTICULAR SOLID SURFACES, AND OPERATING MACHINE EQUIPPED WITH SAID EXCAVATING EQUIPMENT

CROSS REFERENCE TO RELATED APPLICATIONS

This application is a national phase of PCT application No. PCT/EP2015/070687, filed Sep. 10, 2015, which claims priority to IT patent application No. MI2014A001567, filed Sep. 10, 2014, all of which are incorporated herein by reference thereto.

TECHNICAL FIELD OF THE PRESENT INVENTION

The present invention relates to the excavation of surfaces, in particular of solid floorings such as for example floorings made of cement, asphalt or similar solid material. Thus, the present invention relates to an equipment for realising excavations and/or trenches with predefined length and/or depth in surfaces and/or floorings of the aforementioned type. In detail, the present invention relates to a solution for setting the working depth of equipment of the aforementioned type; even more in detail, the present invention relates to a solution aimed at allowing automatic positioning of an equipment of the aforementioned type in the best operating conditions possible.

STATE OF THE ART

Machines and/or equipment for working surfaces, in particular surfaces and/or solid floorings, for example made of cement and/or asphalt and/or similar solid material are known in the prior art and commonly used. For example, there are known graders, in particular hydraulic graders, for the demolition and/or grading of solid surfaces of the aforementioned type. Also known are excavating machines and/or equipments, usually of the hydraulic type, for obtaining and/or excavating trenches with predefined width and/or depth in surfaces and/or solid floorings of the aforementioned type. In particular, there is an ever-growing need for laying pipes (for example for gas and water) but also electrical and/or telephone cables, optical fibre etc which has led manufacturers of equipments of the aforementioned type, in particular called trench excavators or even more simply "trenchers", to direct considerable effort to the development of more and more reliable and/or performing trench excavators. However, the trench excavation equipments of the known type still reveals some drawbacks that negatively affect the performances thereof.

A trench excavation equipment of the known type is in particular represented schematically in FIGS. 1*a* and 1*b*, wherein the equipment is identified in its entirety by the reference numeral 10.

The equipment 10 comprises in particular an excavation wheel 6 provided with excavation teeth or punchers 7 which, during the rotation of the wheel 6 in the direction indicated by the arrow are engaged in the surface S, wherein the excavated material is removed and brought to surface. The excavation wheel 6 is in particular rotated by means of an hydraulic motor 5 directly applied to the wheel 6 and fixed to the main supporting frame 1 which in particular comprises a coupling 13 by means of which the equipment can be coupled (fixed or applied) to a main operating machine.

The motor 5 and the corresponding excavation wheel 6 are thus fixed to the main frame 1 in a predefined position. The equipment 10 also further comprises a setting frame 2 which allows setting the excavation depth K of the wheel 6. The setting frame 2 is actually fixed to the main supporting frame 1 by means of setting means 12, for example a hydraulic jack, a hydraulic piston or similar means, alternatively extensible and retractable. Thus, it arises that the means 12 allow setting the mutual position of the setting frame 2 and the main frame 1 between the minimum extension position of the FIG. 1*a* (setting frame entirely up) and the maximum extension of FIG. 1*b* (setting frame entirely down). In addition, given that the setting frame 2 is provided with a contact surface 3 which is kept at contact with the surface S to be worked on during excavation, the mutual arrangements of the main frame 1 and the setting frame 2, respectively of FIGS. 1*a* and 1*b*, respectively allow the maximum and minimum excavation depth.

In FIGS. 2*a*, 2*b* and 2*c* an equipment 10 according to the prior art is applied to an operating machine and/or main driving means 100, in particular to the arm or mobile support 101 of the machine 100, wherein FIGS. 2*b* and 2*c* show some drawbacks affecting operating machines of the known type.

During the excavation of a trench, with the excavation wheel 6 rotating as described above, the operating machine 100 is moved forward or backward respectively on one of the two directions of advancement indicated by the two arrows (from right to left or from left to right in the figures) so as to push or respectively drive the equipment 10 and thus advance it or recede it in the same direction of advancement. For the sake of clarity, it will be assumed hereinafter that the operating machine 100 and thus the equipment 10 move from left to right in the figures. In the ideal condition of FIG. 2*a*, the supporting surfaces 3 are completely at contact with the surface S and during the operations, with the excavation wheel 6 rotating, the obtained and/or excavated material is unloaded from inside the equipment 10 towards the external through the discharge windows 2*f* (one or more for each side of the setting frame 2, or even on one side, the windows 2*f* being formed in variable positions depending on the model). FIG. 2*b* instead shows the situation in which the equipment 10, with respect to the ideal situation of the FIG. 2*a*, is rotated clockwise hence only the rear part of the support surface 3 is at contact with the surface S to be worked on, wherein a situation of this type can for example be due to movements of the arm or mobile support 101 deriving from the tolerances of the hydraulic system or even from the inevitable variations of the hydraulic pressure in the main hydraulic system of the machine 100, or even an excessive or unintentional lowering of the arm or mobile support 101 by the operator (who, it should be kept in mind, under normal operating conditions cannot directly see the actual position or the actual orientation of the equipment with respect to the surface S) or also for example in the presence of unevenness of the surface S along the path of the operating machine 100). In these conditions the actual working depth K1 is lesser than the expected or planned depth K, wherein a low working depth obviously implies additional costs for example due to the need of reaching the planned depth by means of a second excavation operation. In addition, due to the unstable resting of the support surface 3, and thus of the entire equipment, on the surface S, the equipment 10 is subjected to excessive vibrations that may also lead, in some cases, to breaking or damaging the equipment and/or parts thereof.

However, the most serious drawback lies in the fact that, with the equipment in the position depicted in FIG. 2*b*, the excavated material may at least partly accumulate under the setting frame 2, in particular under the supporting surfaces 3 and/or fall back into the trench (instead of exiting from the setting frame through the discharge windows 2*f* as previously mentioned with reference to FIG. 2*a*); in this situation, during the further advancement of the equipment, the equipment will be pushed even further upwards due to the surfaces 3 resting on the excavated material, further reducing the discharge depth.

FIG. 2*c* instead represents the situation in which the equipment 10, with respect to the ideal situation of FIG. 2*a*, is rotated anticlockwise hence only the front part of the support surface 3 is at contact with the surface S to be worked on, wherein a situation of this type may be due to the same reasons mentioned previously with reference to FIG. 2*b* (for example excessive and/or unintentional or inadvertent lifting of the arm or mobile support 101 by the operator, movements of the arm or mobile support 101 deriving from the tolerances of the hydraulic system or even the inevitable variations of the hydraulic pressure in the main hydraulic system of the machine 100 etcetera). Even in these conditions, the actual working depth K1 will be smaller than the expected or planned depth K, wherein an insufficient depth obviously implies additional costs, for example due to the need of completing the trench through a second excavation operation. Furthermore, even in this case, due to the unstable resting of the support surface 3, and thus of the entire equipment, on the surface S, the equipment 10 is subjected to excessive vibrations that may also lead, in some cases, to breaking or damaging the equipment and/or parts thereof. And lastly, even in this case, there arises the drawback regarding excavated material that partly falls back into the trench.

In view of the above, the main object of the present invention is to overcome or at least minimise the drawbacks affecting the equipments according to the prior art. In particular, an object of the present invention is to overcome the drawbacks of the equipments according to the prior art as described previously with reference to FIGS. 2*b* and 2*c*. In particular, a further object of the present invention is to obtain an equipment of the aforementioned type in which the surface for supporting the setting frame on the ground is always substantially entirely at contact with the surface to be worked on, regardless of the conditions of the aforementioned surface and/or any distraction or manoeuvre errors. In addition, a further object of the present invention is to obtain an equipment in which the setting of the mutual position of the main frame and the setting frame, and thus of the excavation or working depth, is such to guarantee the perfect support of the setting frame on the ground, regardless of the working depth set through the depth setting means.

In the light of the objects described above, the present invention is based on the general consideration according to which the objects in question may be attained through an equipment in which the setting frame is not simply translatable with respect to the main supporting frame but it has a given freedom of rotation with respect to the main supporting frame.

DESCRIPTION OF THE PRESENT INVENTION

In the light of the description outlined above, described in the present application is an equipment for excavating solid surfaces such as for example made of asphalt or cement or similar solid material, in particular for excavating trenches in said solid surfaces, said equipment comprising working or excavating means supported by a main frame, and a setting frame which defines at least one contact portion substantially flat and adapted to be put into contact with a corresponding portion of the surface to be worked on, wherein the position of said setting frame with respect to said main supporting frame may be set so as to set the working depth of said working means; wherein said setting frame is fixed to said main supporting frame in such a way that said main frame and said setting frame can be rotated one with respect to the other.

Still as described in the present application, said setting frame is fixed to said main supporting frame by means of a first fixing arm pivotally fixed on said main supporting frame, in such a way that rotating said fixing arm around said pivot in two opposite rotation directions results in said setting frame being rotated with respect to said main supporting frame in two opposite translation directions, respectively.

According to a particular embodiment as described in the present application, said fixing arm may be realised as a first class lever, wherein said setting frame is rotatably fixed to a first end portion of said fixing arm which comprises the point on which the resistance of said lever is applied.

Still in the light of the above description, the present invention relates to an equipment for excavating surfaces or solid floorings such as for example made of asphalt or cement or similar solid material, in particular for excavating trenches in said surfaces or solid floorings, said equipment comprising rotatable working or excavating means supported by a main frame with a coupling of generic type for operatively coupling said equipment to the mobile arm or support of a main operating machine, and a setting frame which defines at least one contact portion substantially flat and adapted to be put into contact with a corresponding portion of the surface to be worked on, wherein said main frame is housed (received) in an internal space defined by said setting frame; wherein said setting frame is fixed to said main supporting frame in such a way that said setting frame can be translated with respect to said main frame on a plane perpendicular to the axis of rotation of said working or excavating means, and wherein said main frame and said setting frame can be rotated one with respect to the other on a main rotation axis substantially parallel to the rotation axis of said rotatable working or excavating means.

According to an embodiment, said main supporting frame and said setting frame are mutually coupled by means of a first engagement pin which extends along a direction substantially parallel to said main rotation axis and comprises at least one free end portion, wherein said free end portion of said engagement pin is engaged in a first engagement slot, and wherein said first engagement slot extends along an arc-shaped or semicircular development, said first engagement pin being thus adapted to be translated along said first engagement slot.

According to an embodiment, said first engagement slot is formed in said setting frame.

According to an embodiment, said main supporting frame and said setting frame are reciprocally or mutually coupled by means of a second guiding pin which extends along a direction substantially parallel to the direction of extension of said first pin and comprises at least a free end portion, said equipment comprising a second guiding slot in which there is engaged the free end of said second guiding pin, said second guiding slot extending along an arc-shaped or semicircular development, said second guiding pin being thus adapted to be translated along said second guiding slot.

According to an embodiment, said second guiding slot is formed in said setting frame and said second guiding pin extends outwards from said main supporting frame.

According to an embodiment, said first and second slot extend along corresponding paths which are not parallel to each other.

According to an embodiment, said equipment comprises guiding means which comprise a proximity portion extending along a direction substantially parallel to the plane of rotation of said working or excavating means, along with a plate shaped end portion extending from said proximity portion substantially parallel to the plane of rotation of said working or excavating means, wherein said proximity portion and said end portion define an engagement space in which there is received in a slidable manner a portion of said setting frame or of said main supporting frame.

According to an embodiment, said proximity portion extends outwards from said main supporting frame.

According to an embodiment, said equipment comprises setting means adapted to allow setting the position of said setting frame with respect to said main supporting frame in a manner such to allow the setting of the working depth of said working means.

According to an embodiment, said setting means comprise a first coupling arm pivotally coupled on said main supporting frame by means of a pivot, wherein said first pin extends from said first coupling arm, and wherein said setting frame is coupled to said main frame by means of said first coupling arm, in such a way that rotating said fixing arm around said pivot in two opposite rotation directions results in said setting frame being translated with respect to said main supporting frame respectively in two opposite translation directions.

According to an embodiment, said coupling arm is realised as a first class lever, wherein said first pin is positioned in correspondence or proximity of a first end portion of said coupling arm which comprises the point on which the resistance of said lever is applied.

According to an embodiment, the second end portion of said coupling arm opposite to said first end portion comprises the point on which power is applied and said first and second end portions extend along directions which are not parallel and converge in the pivot of said lever.

According to an embodiment, the angle defined by said first and second end portions of said coupling arm is less than 180°.

According to an embodiment, said equipment comprises actuating means adapted to be extended and retracted and applied on said second end portion of said coupling arm in such a way that the extension of said actuating means results in a rotation of said arm in a rotation direction while the retraction of said actuating means results in a rotation of said arm in the opposite direction.

An operating machine for excavating solid surfaces such as for example made of asphalt or cement or similar solid material, in particular for excavating trenches in said solid surfaces forms an object of the present invention, said operating machine being equipped with an equipment according to the present invention.

Further embodiments of the equipment and the operating machine according to the present invention are defined in the dependent claims.

BRIEF DESCRIPTION OF THE FIGURES

In the following, the present invention will be clarified through the description of some embodiments thereof represented in the attached drawings. However, it should be noted that the present invention is not limited to the embodiments depicted in the drawings; on the contrary, all variants or modifications of the embodiments represented and described hereinafter deemed clear, obvious and evincible to a man skilled in the art fall within the scope and object of the present invention. In particular, in the attached drawings:

Each of FIGS. 1*a* and 1*b* show a lateral view of a trench excavation equipment according to the prior art;

Figure 1A:
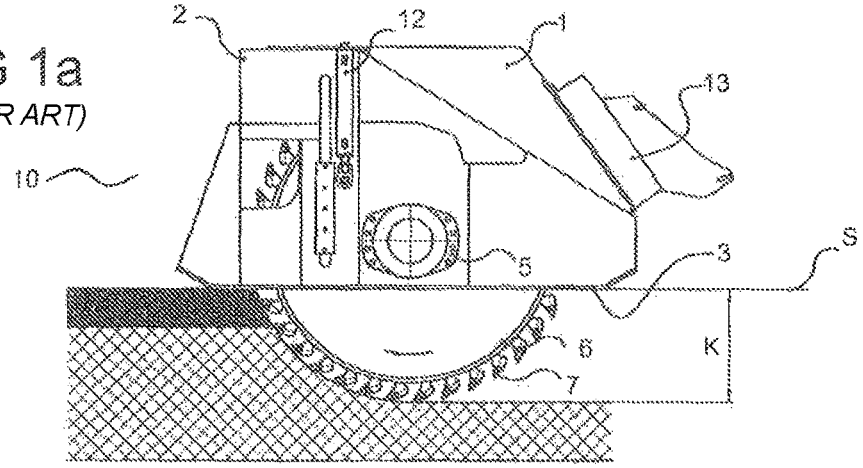
FIG 1a (PRIOR ART)
Figure 1B:
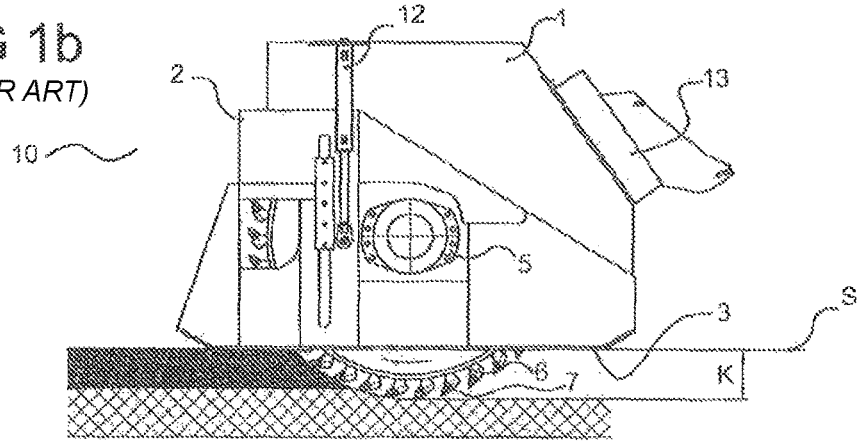
FIG 1b (PRIOR ART)
Figure 3B:
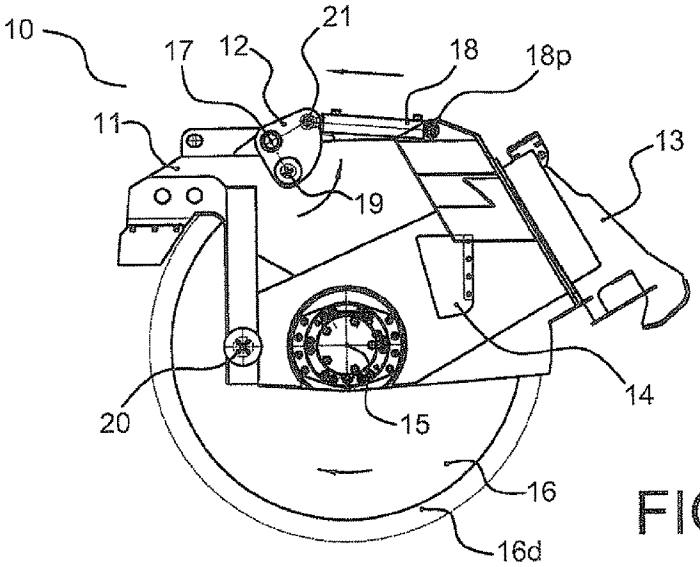
Figure 3A:
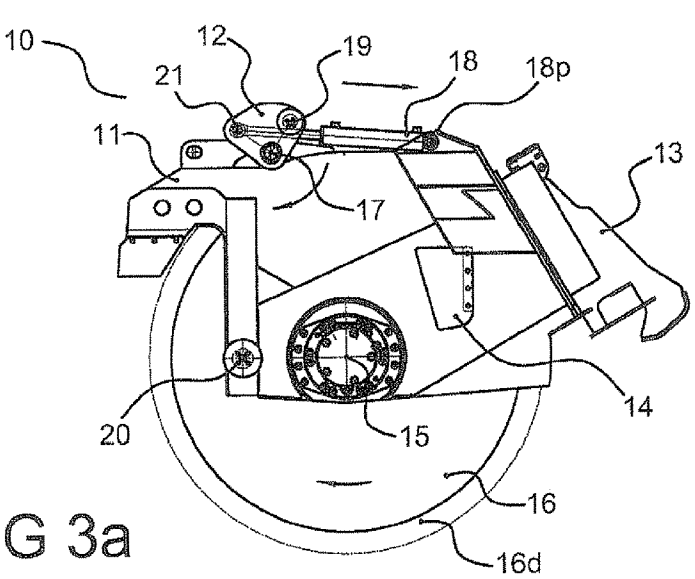
Figure 4:
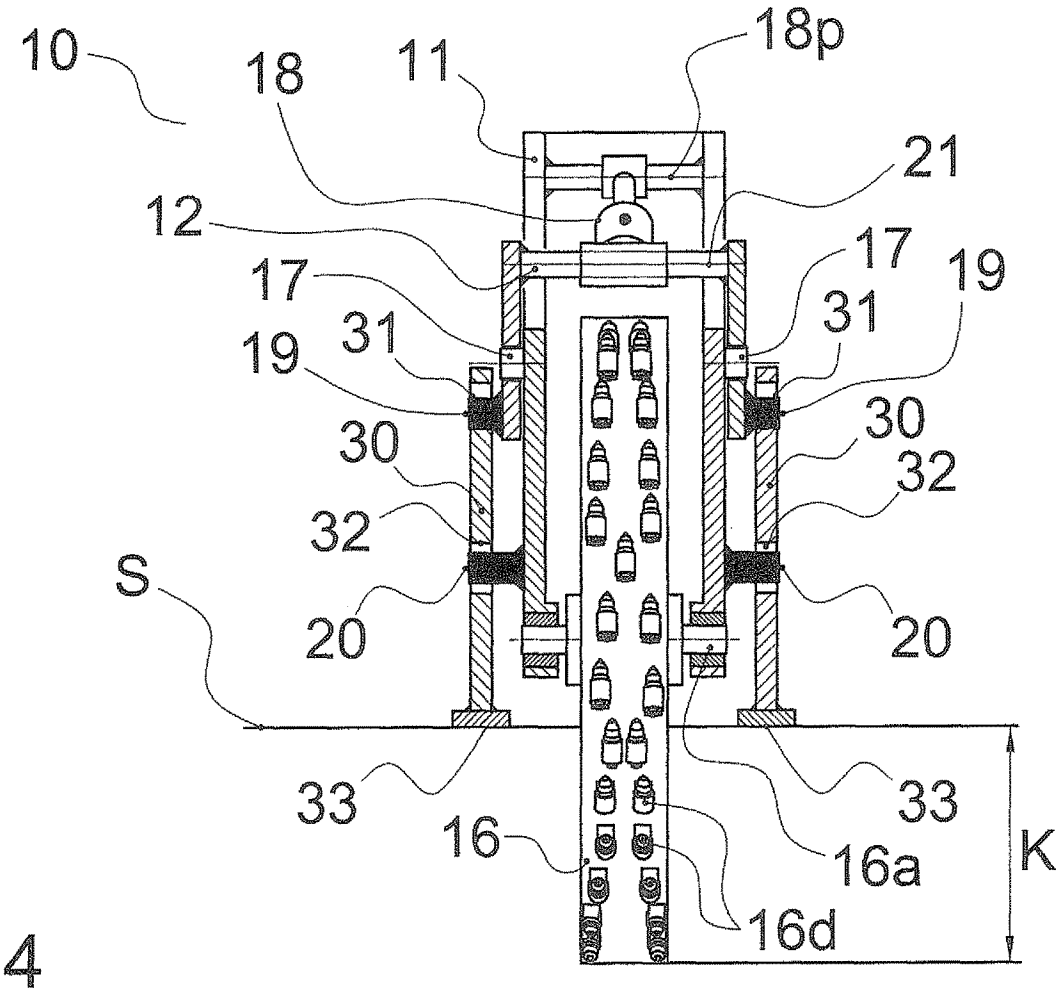
Figure 6A:
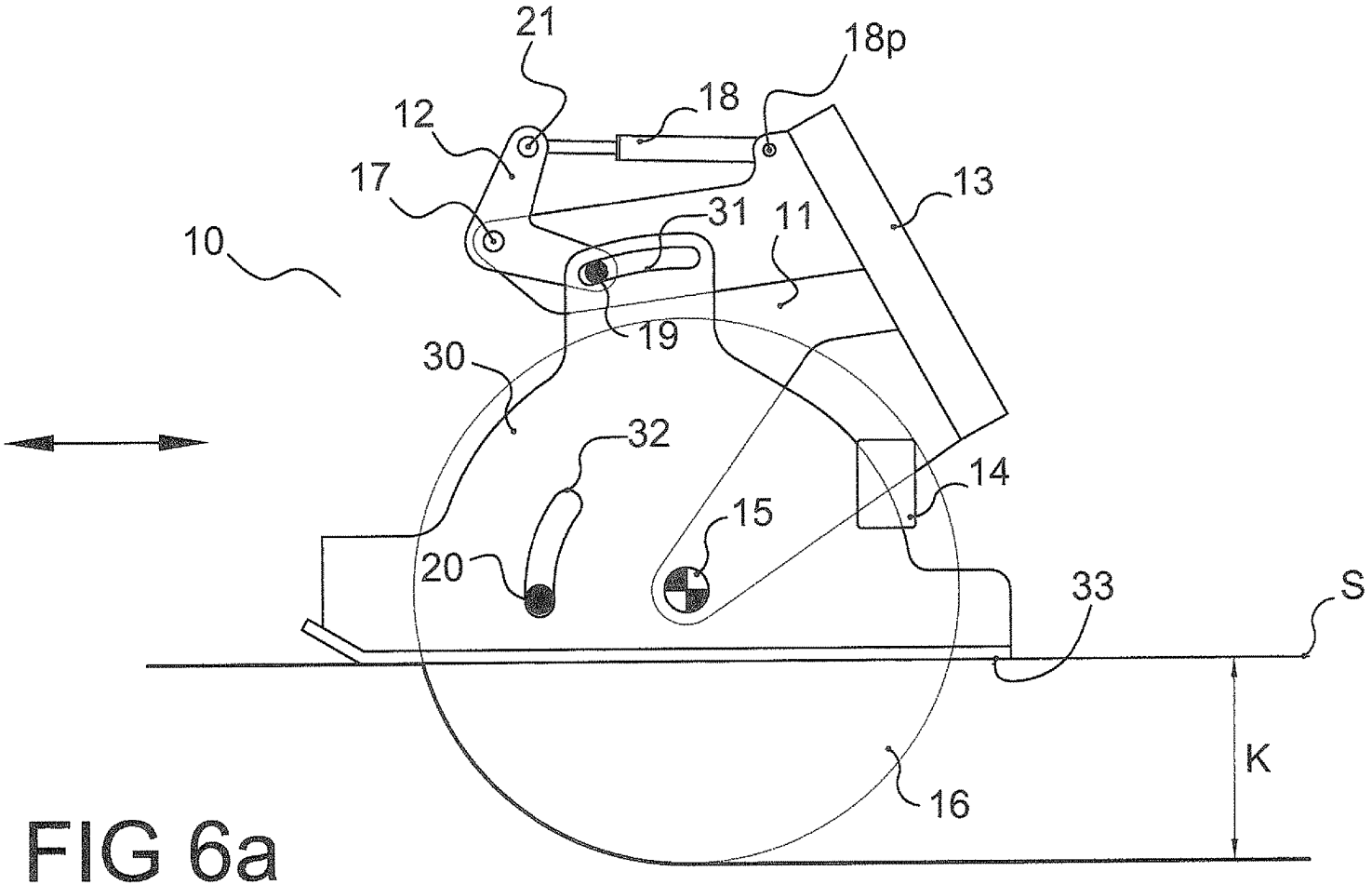
Figure 6B:
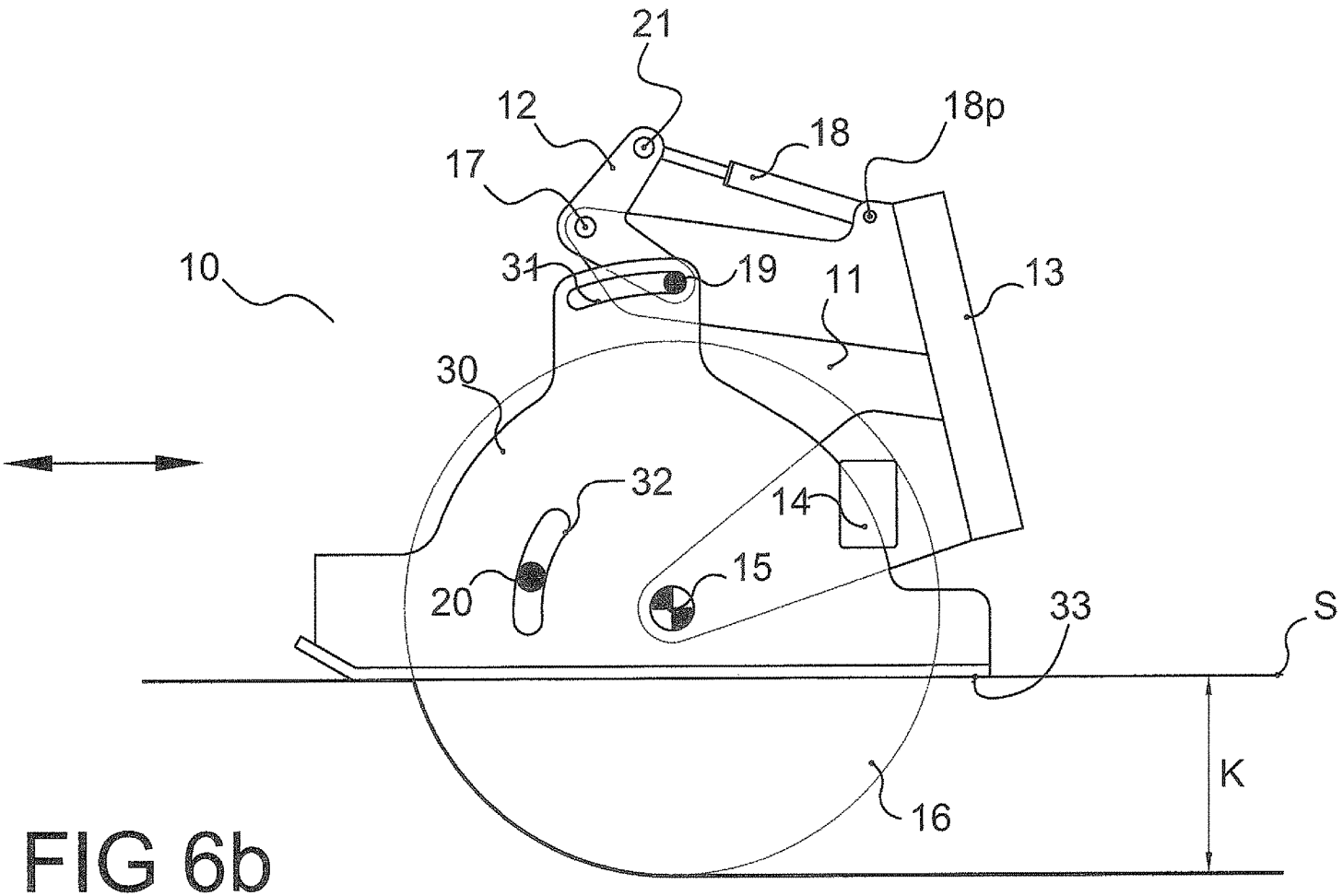
Figure 6C:
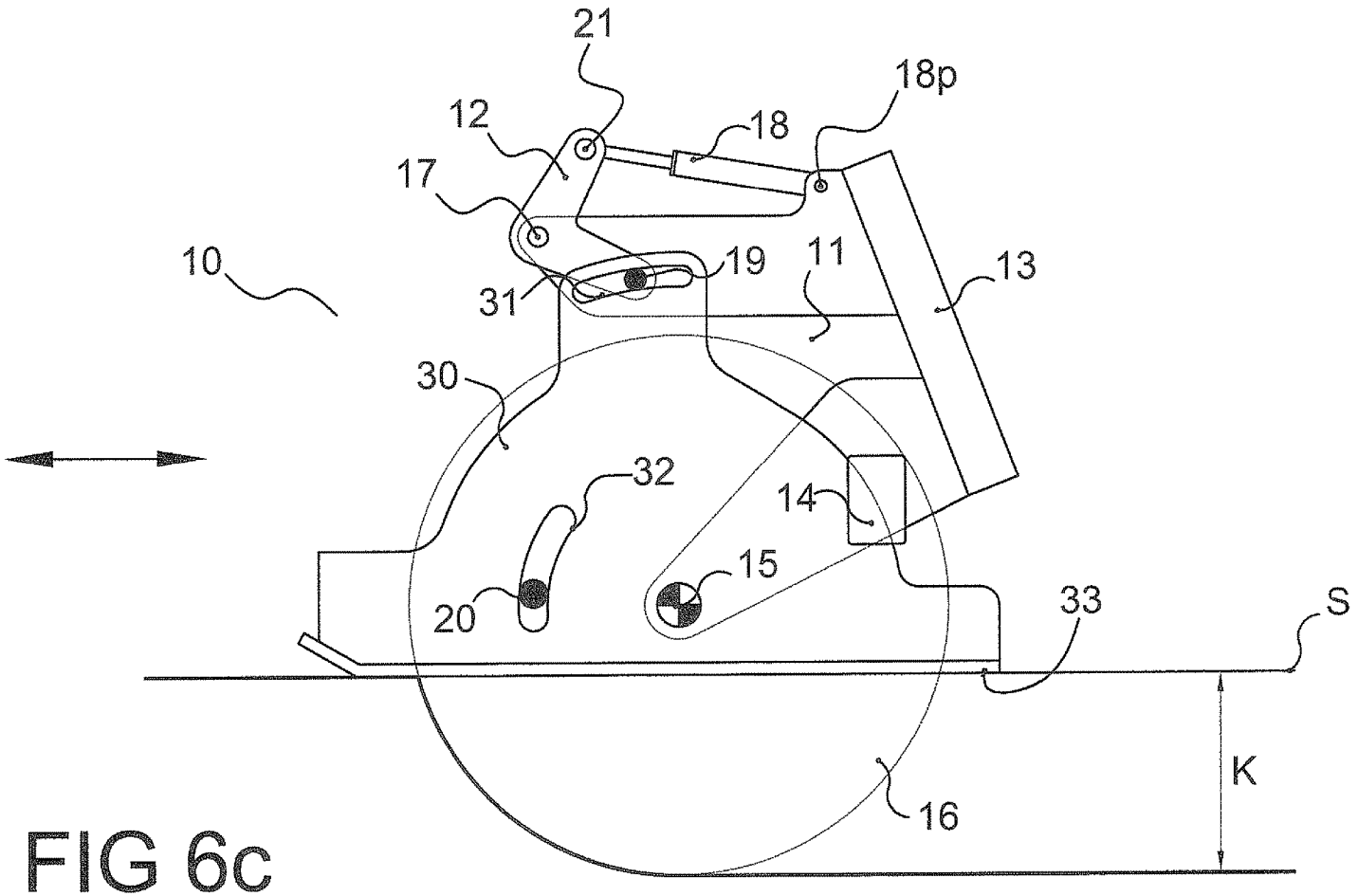
Figure 7:
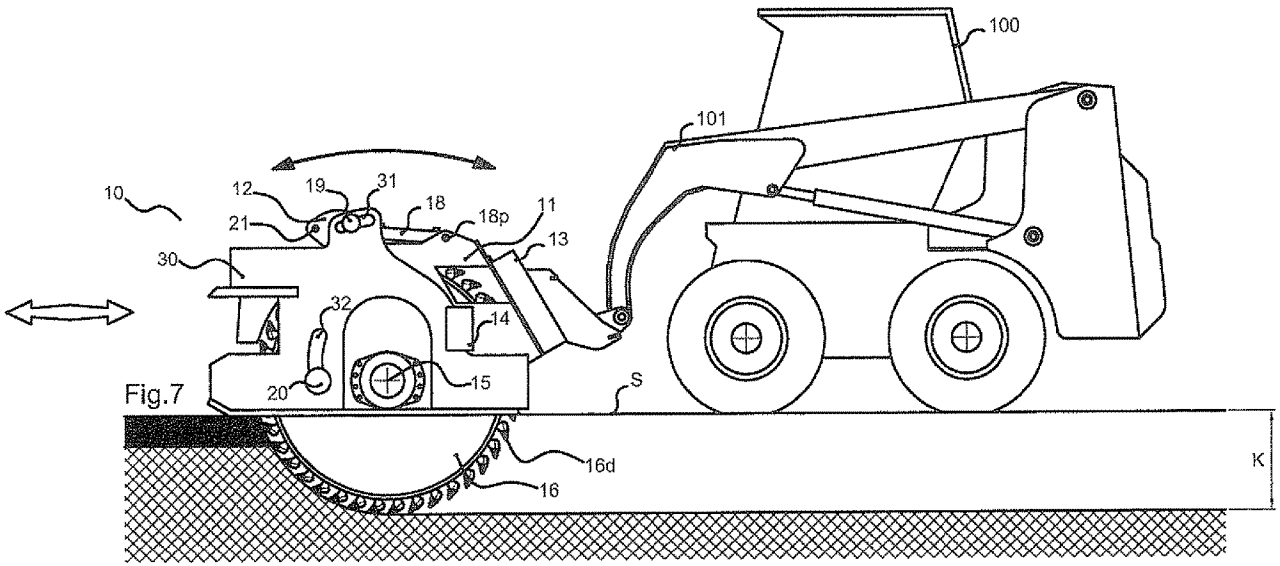
Figure 8B:
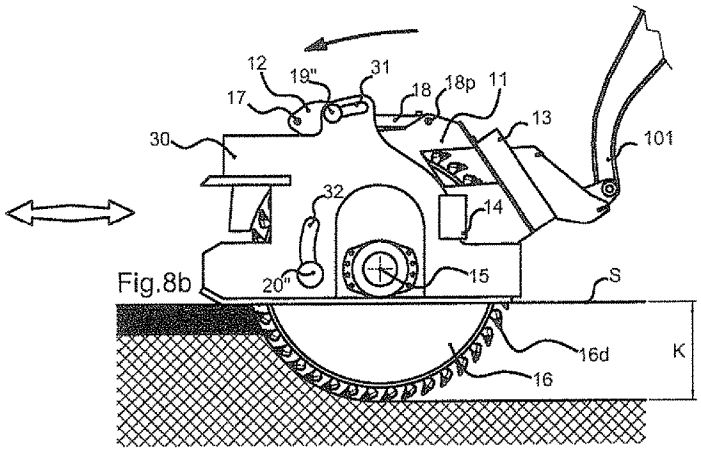
Figure 8A:
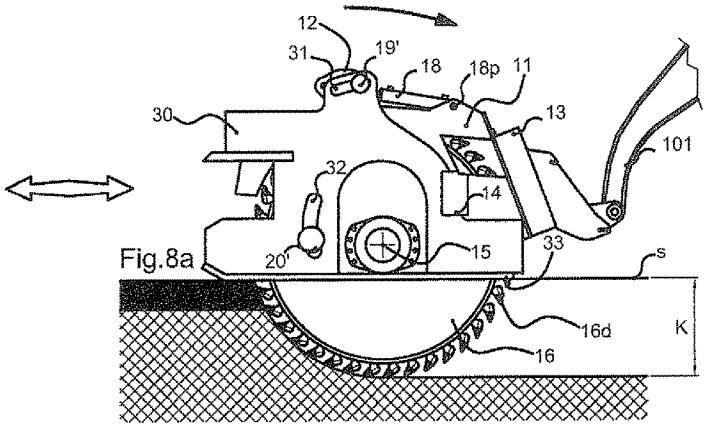

Each of FIGS. 2*a* to 2*c* shows, in a lateral view, an operating machine equipped with a trench excavation equipment according to the prior art;

Each of FIGS. 3*a* and 3*b* shows a lateral view of a trench excavation equipment according to an embodiment of the present invention in which, for the sake of clarity, the setting frame of the equipment is not depicted;

FIG. 4 shows a sectional view of an equipment according to an embodiment of the present invention;

each of FIGS. 5*a* and 5*b* shows a lateral view of a trench excavation equipment according to an embodiment of the present invention;

FIG. 5*c* shows a top view of a detail of an equipment according to an embodiment of the present invention;

FIGS. 6*a* to 6*c* show lateral views of the equipment according to the present invention in respectively different operating conditions;

FIG. 7 shows a lateral view of an operating machine equipped with an equipment according to an embodiment of the present invention;

FIGS. 8*a* and 8*b* show lateral views of an equipment according to an embodiment of the present invention in respectively different operating conditions.

DETAILED DESCRIPTION OF THE PRESENT INVENTION

The present invention particularly and effectively applies to trench excavation equipments; thus, this is the reason why the present invention will be described hereinafter with particular reference to its application in the case of a trench excavation equipment or trench excavator.

However, the possible applications of the present invention are not limited to the case of trench excavation equipment and/or trench excavators; on the contrary, the present invention effectively and conveniently applies to different equipments such as for example grinding equipments for grinding surfaces or for working and/or demolishing surfaces, in particular solid surfaces.

In FIGS. 3*a*, 3*b* and 4, the equipment according to the embodiment of the present invention depicted therein is identified in its entirety by the reference number 10, wherein in FIGS. 3*a* and 3*b* the setting frame of the equipment is not depicted for the sake of description clarity. The equipment 10 in particular comprises a main supporting frame 11 with a general coupling 13 for the operating coupling of the equipment 10 to the arm or mobile support of an operating machine and/or main motor (see the following description). The main supporting frame 11 is essentially constituted by two parallel plates which define an interior space for housing excavation means essentially constituted by an excavation wheel 16 provided with teeth or excavation punchers 16*d* arranged on the external peripheral surface; in an essentially known manner, by rotating the excavation wheel 16 in the rotation direction indicated by the arrows in FIGS. 3*a* and 3*b* (clockwise rotation with respect to the figures) the punchers or teeth 16*d* are engaged in the ground, wherein the excavated material is removed and brought to surface, in particular discharged outside the setting frame (see the following description). However, it should be observed that the applications of the present invention are not limited to the case of excavators with excavation wheel but also for example comprise excavators with excavation chain. In the case of the excavation wheel represented in the figures, a rotation axle 16*a* (FIG. 4) of the excavation wheel 16 rotatably extends between the two parallel plates of the main frame 11, wherein the excavation wheel 16 is rotated by means of a power source 15, for example a hydraulic motor which rotates the axle 16*a*. A second axle 18*p* extends between the two parallel plates of the main frame 11. In addition, from each of the two parallel plates of the main frame 11 a pivot 17 extends towards the external; on the rotation pivots 17 there is pivoted a fixing and/or setting and/or coupling arm 12 adapted to be rotated with respect to the rotation axis defined by the pivots 17 in the two directions of rotation indicated by the arrows respectively in FIGS. 3*a* and 3*b*, and thus between the two end positions respectively represented in FIGS. 3*a* and 3*b*. In addition, FIG. 4 shows how the fixing and/or setting element or arm 12 is also constituted by two parallel plates arranged externally with respect to the parallel plates of the main supporting frame 11 and each pivoted on one of the pivoting pins 17 of the main frame 11. Between the parallel plates of the rotatable fixing and/or setting arm or element 12 there also extends an axle 21 rigidly fixed between the two plates of the arm 12. Between the axle 18*p* of the main supporting frame 11 and the axle 21 of the fixing and/or setting arm or element 12 there are arranged actuating means adapted to be extended and retracted, for example a hydraulic piston 18. With particular reference to FIGS. 3*a* and 3*b*, it is thus observable how an extension of the piston 18 (from left to right in the figures) results in an anticlockwise rotation of the arm 12 with respect to the pivoting pins 17, while on the contrary a retraction of the piston 18 (from left to right in the figures) results in a clockwise rotation of the arm 12 still with respect to the pivoting pins 17. It should thus be observed that, as represented in the figures, from each of the two parallel plates of the arm or element 12 an engagement pin extends outwards 19, thus it can be observed, with particular reference to FIGS. 3*a* and 3*b* that an anticlockwise rotation of the arm 12 corresponds to an upward excursion of the pins 19, while on the contrary a clockwise rotation of the arm 12 results in a downward excursion of the pins 19.

Now, with reference to FIGS. 4, 5*a* and 5*b* (wherein in FIGS. 5*a* and 5*b* the characteristics and/or component parts of the equipment 10 represented therein and possibly described beforehand with reference to other figures are identified by the same reference numerals) it is observable that the equipment 10 comprises a mobile setting frame 30 which comprises two parallel plates which define an interior space in which the main frame 11 and the fixing and/or setting arm 12 are housed, wherein each of the two plates comprises a support foot which defines a substantially flat support surface which, during the operation of the equipment 10, is adjusted to lie on the surface S to be worked on, in which in particular trench excavation operations are to be carried out. In particular, each of the two parallel plates of the setting frame 30 is provided with an engagement slot in which one of the engagement pins 19 of the fixing and/or setting arm 12 is engaged. Thus, as represented in particular in FIGS. 5*a* and 5*b*, during the rotation of the fixing and/or setting arm 12 in the two opposite anticlockwise and clockwise rotation directions (respectively FIGS. 3*a* and 3*b*) the two engagement pins 19, in their respectively upward and downward excursions, drive the setting frame 30 with respect to the main supporting frame 11 respectively between the two positions represented in FIGS. 5*a* (setting frame 30 entirely upwards) and 5*b* (setting frame 30 entirely downwards). Thus, considering that, as mentioned previously and as represented in the figures, during the operation of the equipment 10, the supporting surfaces 30 are kept resting on the surface S to be worked on, the two mutual positions of the setting frame 30 with respect to the supporting frame 12 represented in FIGS. 5*a* and 5*b* respectively correspond to the two conditions and/or positions of maximum excavation depth K and minimum excavation depth K, wherein obviously the setting frame 30, with respect to the main supporting frame 12, may take any intermediate position between the aforementioned two end positions, hence the working depth may be any depth comprised between the maximum depth and minimum depth described above.

In the light of the description above, in particular it is thus to be observed that the fixing or coupling arm or element 12 is realised as a first class lever, in particular in which the resistance (constituted by the setting frame 30) is applied to an end of the lever or arm (to the pins 19), the power (generated by the actuating means 18) is applied to the opposite end of the lever or arm 12 (to the axle 21), while the pivot of the lever (constituted by the pivoting pins 17) is arranged in an intermediate position between the points of application, respectively the resistance and power application points.

Obviously, alternative solutions with respect to the one described above in which the engagement slots 31 are provided not already in the setting frame 30 but in the arm 12 (each in one of the two parallel plates of the arm 12) fall within the scope of the present invention, wherein in this case the two settings pins each extend from one plate of the setting frame 30 inwards and each are engaged in a corresponding slot 31.

Solutions for setting the working and/or excavation depths different from the one described above which essentially comprises the arm or pivot 12 and the hydraulic piston 18 also fall within the scope of the present invention; for example, solutions similar to those represented in FIGS. 1*a*, 1*b*, 2*a*, 2*b* and 2*c* and clarified through the corresponding description, i.e. solutions comprising setting means 12 adapted to be extended and retracted, for example a hydraulic jack, a hydraulic piston or similar means, directly interposed between the supporting frame 11 and the setting frame 30, wherein the direction of extension of said means is substantially parallel to the direction of translation of the setting frame with respect to the main one fall within the scope of the present invention.

Still with reference to FIGS. 5*a* and 5*b* it can also be observed that each of the engagement slots 31 has an arc or semicircular extension (essentially centred on the rotation axis of the excavation wheel 16). In case of the equipment according to the present invention, the setting of the position of the setting frame 30 with respect to the main supporting frame 11, and thus the setting of the excavation depth of the excavation wheel 16, is thus obtained simply by using a piston 18, in particular extending it (to increase the excavation depth) and respectively retracting it (to reduce the excavation depth).

Two additional engagement pins 20 further extend outwards, each respectively from one of the two parallel plates of the main supporting frame 11, wherein each of the engagement pins 20 is engaged in a further engagement slot 32, each of the two further engagement slots 32 being formed in one of the two parallel plates of the fixing and/or setting frame 30, the engagement slots 32 also having an arc or semicircular extension essentially centred on the rotation axis of the excavation wheel 16, the extension of the slots 32 however not being parallel to that of the slots 31.

In addition, further guiding means 14 are provided on each of the opposite sides of the main supporting frame 11, wherein as represented in FIG. 5*c*, each of the means 14 comprises a proximity portion 14*p* which extends outwards from the main frame 11 (from the corresponding plate of the frame 11), and an end portion 14*e* substantially parallel to the respective plate of the main frame 11, in such a way that the proximity 14*p* and end 14*e* portions define an interior space 14*s* in which there is housed a portion of the setting frame 30.

Obviously, even in this case, alternative solutions fall within the scope of the present invention, in which for example the two further engagement pins 20 extend inwards respectively into the two parallel plates of the setting frame 30 wherein each of the engagement pins 20 are engaged in a further engagement slot 32, the two further engagement slots 32 being formed in one of the two parallel plates of the main supporting frame 11 in this case.

In the same way, the further guiding means 14 may be provided on each of the opposite sides of the setting frame 30, wherein in this case, each of the means 14 comprises a proximity portion 14*p* extending inwards from the setting frame 30, and an end portion 14*e* substantially parallel to the respective plate of the setting frame 30, in such a way that the proximity 14*p* and end 14*e* portions define an interior space 14*s* in which a portion of the main supporting frame 11 is housed.

In addition, in the scope of the present invention, the guiding means 14 may be substituted by a system with engagement slots and pins, while the slots 32 and the respective engagement pins 20 may be substituted by the guiding means 14.

The function of the slots 31 and 32 and the respective engagement pins 19 and 20 is represented in FIGS. 6*a*, 6*b* and 6*c*, wherein, for the sake of description clarity, the main supporting frame 11 is represented schematically and also wherein, characteristics and/or component parts of the equipment 10 according to the embodiment of the present invention represented therein and already described previously with reference to the other figures, are identified by the same reference numerals.

Each of FIGS. 6*a*, 6*b* and 6*c* represents the equipment 10 in operating position, i.e. with each of the supporting surfaces 33 of the parallel plates of the setting frame 30 resting on the surface S to be worked on. In addition, in FIGS. 6*a*, 6*b* and 6*c* the working or excavating depth K is the same, given that the extension of the actuating means 18 is the same in the figures.

What changes in FIGS. 6*a* to 6*c* is the coupling position 13 of the main frame 11, wherein FIG. 6*a* represents the coupling 13 in its highest position (with respect to the surface S), FIG. 6*c* the intermediate height position and FIG. 6*b* the lowest position. As clearly observable from the following description, the various coupling positions 13 may be due to the variation of the operating conditions, as well as for example reckless, inaccurate or inadvertent or unintentional manoeuvres.

To each of the different coupling heights 13 with respect to the surface S there corresponds a respectively different angle of the coupling 13 with respect to the vertical, the coupling being more inclined anticlockwise in the condition of FIG. 6*a* (maximum height), less inclined in the intermediate height condition (FIG. 6*c*) and even less inclined or substantially vertical in the minimum height condition (FIG. 6*b*).

In other words, assuming—for the sake of description clarity—to start from the operating condition represented in FIG. 6*b*, it is observable that, upon lifting the coupling 13, the main frame 11 will be rotated anticlockwise with respect to a rotation axis essentially coinciding with the rotation axis of the excavation means 16. However, the setting frame 30, contrary to the case of equipment according to the prior art, will not be driven in rotation in the same direction of rotation as the main frame 11 due to the engagement guides 31 and 32, in which the respective engagement pins 19 and 20 may translate freely, hence the setting frame 30 will remain in the position of FIG. 6*a*, i.e. with the supporting surfaces perfectly resting on the surface S. Thus, it is observable that due to the configuration of the guides 31 and 32, not only the setting frame 30 is translatable with respect to the main frame in a manner such to allow the setting of the working depth, but the main frame 11 and the setting frame 30 are also not constrained to each other in rotation, i.e. the rotation of the main frame 11 between the two end stop positions represented in FIGS. 6*a* and 6*b* (with the engagement pins 19 at the opposite ends of the respective slots 31), does not result in a rotation of the setting frame 30, which, on the contrary, is maintained in the ideal operating condition, i.e. with the supporting surfaces 33 perfectly resting on the surface S to be worked on.

The description above is particularly observable directly with reference to FIGS. 7, 8*a* and 8*b*, in which the equipment 10 is coupled to a main operating machine 100, wherein the arm or mobile support 101 of the machine 100 is coupled to the coupling 13 of the equipment 10. In the situation represented in FIG. 7, the equipment 10 is set to obtain an excavation or trench with predefined depth K, thus wherein the mutual position of the setting frame 30 with respect to the main supporting frame 11 was set by operating on the actuating means 18 according to the methods described previously.

When performing the excavations, with the excavation wheel 16 driven in rotation through the power source 15, the operating machine 100 advances or recedes in one of the directions indicated by the two arrows in FIGS. 7, 8*a* and 8*b*, with a predefined speed.

FIG. 8*a* instead represents the situation that occurs upon lowering the coupling 13, this lowering for example being due to an inadvertent or unintentional lowering of the support 101 of the machine 100 by an operator (who, as mentioned previously, cannot precisely see the position or direction of the equipment 10 with respect to the surface S, hence the operator cannot see whether the supporting surfaces 33 are rest correctly on the surface S), wherein the lowering of the coupling corresponds to a different inclination of the coupling (more inclined clockwise) with respect to the situation of FIG. 7, and thus wherein the lowering of the coupling 13 results in a clockwise rotation of the entire main supporting frame 11 in the same direction of rotation. However, as represented, and contrary to what occurs in the equipment according to the prior art (FIG. 2*b*), the setting frame, as explained previously, is not driven in rotation but rather remains in the initial position of FIG. 7, i.e. with the supporting surfaces 33 perfectly resting on the surface S. In particular, this is due to the freedom of movement of the pins 19 and 20 within the respective slots 31 and 30, hence the setting frame 30, by a rotation angle defined by the extension of the slots 30 and 31, is not constrained in rotation to the supporting frame 11, but—on the contrary—it is rotatable with respect to the supporting frame 11.

FIG. 8*b* instead represents the situation that occurs upon lifting the coupling 13, the lifting for example being due to an inadvertent lifting of the support 101 of the machine 100 by the operator, wherein the lifting of the coupling corresponds to a different inclination of the coupling (more inclined anticlockwise) with respect to the situation of FIG. 7, and wherein the lifting of the coupling 13 results in an anticlockwise rotation of the entire main supporting frame 11 in the same direction of rotation. However, as represented, and contrary to the case of equipment according to the prior art (FIG. 2*c*), the setting frame, as explained previously, is not driven in rotation but rather remains in the initial position of FIG. 7, i.e. with the supporting surfaces 33 perfectly resting on the surface S.

Thus, it has been shown by means of the previous detailed description of the embodiments of the present invention represented in the drawings, that the present invention allows attaining the preset objects and/or overcoming or at least minimising the drawbacks typical of the prior art solutions.

In particular, according to the present invention, the main frame and the setting frame are not constrained in rotation, thus, even in case of inadvertent or unintentional rotation of the support framework, the setting frame remains in the desired position, i.e. with the supporting surfaces always perfectly lying on the surface to be worked on, thus avoiding accumulation of the excavated material under the supporting surfaces, thus allowing maintaining the working depth constant.

In addition, the equipment according to the present invention allows an accurate and reliable setting of the mutual position of the setting frame and the supporting frame and thus the excavation depth.

Though the present invention has been clarified through the detailed description of its embodiments represented in the drawings, the present invention is obviously not limited to the embodiments described previously and represented in the drawings; on the contrary, all variant embodiments with respect to those described and represented which are deemed to be obvious and evincible to a man skilled in the art fall within the scope of the present invention. For example, according to an alternative embodiment, the guiding means 14 may be replaced by a further pair of guides or slots, each formed in a lateral wall of the guide frame or main frame, and in which there is engaged an engagement or guide pin extending outwards from the main supporting frame or respectively inwards from the guide frame 30. Likewise, the slots 32 and the respective pins 20 may be replaced by guiding means 14 of the previously described type (FIG. 5*c*). In addition, according to further alternative embodiments, the power sources respectively for the actuating means 18 and excavation means may be shared or independent, wherein the actuating means 18 and 15, in particular if of the hydraulic type, may be possibly connected with the main hydraulic circuit of the operating machine 100.

In addition, the hydraulic piston 18 may be replaced for example by a manually settable jack. Furthermore, the possible applications of the present invention are not limited to trench excavation equipments or trench excavators of the wheel and/or chain type, but they can also be applied to any equipment requiring setting the working depth, for example demolition equipment, grinding equipment or the like.

The object or scope of the present invention is thus defined by the claims.

The invention claimed is:

1. Equipment for excavating surfaces or solid floorings (S), said equipment comprising rotatable working or excavating means configured to be rotated on an axis of rotation and supported by a main supporting frame, said main supporting frame comprising a coupling for operatively coupling said equipment to a mobile arm or support of a main operating machine, and a setting frame which defines at least one flat contact portion adapted to be put into contact with a corresponding portion of the surface (S) to be worked on, wherein said main supporting frame is housed or received in an internal space defined by said setting frame; wherein said setting frame is fixed to said main supporting frame in such a way that said setting frame can be translated with respect to said main frame on a plane perpendicular to the axis of rotation of said working or excavating means, wherein said main frame and said setting frame can be rotated one with respect to the other on a main rotation axis parallel to the rotation axis of said rotatable working or excavating means, and wherein said equipment comprises guiding means which comprise a proximity portion extending along a direction parallel to said axis of rotation of said working or excavating means, along with a plate shaped end portion extending from said proximity portion perpendicularly to said axis of rotation of said working or excavating means, wherein said proximity portion and said end portion define an engagement space in which there is permanently received in a slidable manner a portion of said setting frame or of said main supporting frame.

2. The equipment according to claim 1, wherein said main supporting frame and said setting frame are mutually coupled by means of a first engagement pin which extends along a direction parallel to said main rotation axis and comprises at least one free end portion, wherein said free end portion of said engagement pin is engaged in a first engagement slot of said setting frame, and wherein said first engagement slot has an arc or semicircular shape, said first engagement pin being thus adapted to be translated along said first engagement slot.

3. The equipment according to claim 2, wherein said main supporting frame and said setting frame are reciprocally or mutually coupled by means of a second guiding pin which extends along a direction parallel to the direction of extension of said first pin and comprises at least a free end portion, wherein said setting frame comprises a second guiding slot in which there is engaged the free end of said second guiding pin, and wherein said second guiding slot has an arc or semicircular shape, said second guiding pin being thus adapted to be translated along said second guiding slot.

4. The equipment according to claim 3, wherein said first and second slot extend along corresponding paths which are not parallel to each other.

5. The equipment according to claim 3, wherein said equipment comprises setting means adapted to allow setting the position of said setting frame with respect to said main supporting frame.

6. The equipment according to claim 2, wherein said equipment comprises setting means adapted to allow setting the position of said setting frame with respect to said main supporting frame.

7. The equipment according to claim 1, wherein the said proximity portion extends outwards from said main supporting frame.

8. The equipment according to claim 1, wherein said equipment comprises setting means adapted to allow setting the position of said setting frame with respect to said main supporting frame.

9. The equipment according to claim 8, wherein said setting means comprise a first coupling arm pivotally coupled on said main supporting frame by means of a pivot, wherein said first pin extends from said first coupling arm, and wherein said setting frame is coupled to said main frame by means of said first coupling arm, in such a way that rotating said first coupling arm around said pivot in two opposite rotation directions results in said setting frame being translated with respect to said main supporting frame respectively in two opposite translation directions.

10. The equipment according to claim 9, wherein said first coupling arm is realized as a first class lever, wherein said first pin is positioned in correspondence or proximity of a first end portion of said coupling arm which comprises the point on which the resistance of said lever is applied.

11. The equipment according to claim 10, wherein a second end portion of said coupling arm opposite to said first end portion and which comprises the point on which power is applied and said first end portion extend along directions which are not parallel and converge in the pivot of said lever.

12. The equipment according to claim 11, wherein an angle defined by said first and second end portion of said coupling arm is less than 180° .

13. The equipment according to claim 10, wherein said equipment comprises actuating means adapted to be extended and retracted and applied on a second end portion of said coupling arm in such a way that the extension of said actuating means results in a rotation of said arm in a rotation direction while the retraction of said actuating means results in a rotation of said arm in the opposite direction.

14. An operating machine for working solid surfaces including excavating trenches in said solid surfaces, wherein said operating machine is equipped with an equipment according to claim 1.

15. The operating machine according to claim 14, wherein said equipment is fixed to said operating machine by means of a hydraulically activated working or supporting arm.

16. The operating machine according to claim 15, wherein an actuating means and/or a working means are respectively of the hydraulic type and hydraulically actuated and are connected to a main hydraulic circuit of said operating machine.

17. The operating machine according to claim 14, wherein said solid surfaces include at least one of asphalt and cement.

* * * * *